US008866727B2

(12) United States Patent
Choi et al.

(10) Patent No.: US 8,866,727 B2
(45) Date of Patent: Oct. 21, 2014

(54) METHOD FOR DRIVING A LIGHT SOURCE APPARATUS WITH VARYING LUMINANCE AND A DISPLAY APPARATUS HAVING THE LIGHT SOURCE APPARATUS

(75) Inventors: Min-Soo Choi, Cheonan-si (KR); Min-Gyu Kim, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 1259 days.

(21) Appl. No.: 12/572,210

(22) Filed: Oct. 1, 2009

(65) Prior Publication Data

US 2010/0134532 A1 Jun. 3, 2010

(30) Foreign Application Priority Data

Dec. 2, 2008 (KR) ..... 10-2008-0121123

(51) Int. Cl.
*G09G 3/36* (2006.01)
*G09G 3/34* (2006.01)

(52) U.S. Cl.
CPC ..... *G09G 3/3413* (2013.01); *G09G 2360/145* (2013.01); *G09G 2320/0693* (2013.01); *G09G 2320/0666* (2013.01); *G09G 2360/16* (2013.01); *G09G 2320/064* (2013.01); *G09G 2320/043* (2013.01); *G09G 2320/0606* (2013.01)
USPC ..... 345/102; 345/204; 345/690; 345/89; 313/512; 362/97.2

(58) Field of Classification Search
USPC ..... 345/102, 690, 89, 204; 313/512; 3/586; 398/25; 362/97.1–97.3
See application file for complete search history.

(56) References Cited

U.S. PATENT DOCUMENTS

| | | | | |
|---|---|---|---|---|
| 6,329,964 | B1 * | 12/2001 | Tanaka | 345/8 |
| 6,888,528 | B2 * | 5/2005 | Rai et al. | 345/102 |
| 7,108,413 | B2 * | 9/2006 | Kwong et al. | 362/583 |
| 2003/0230991 | A1 | 12/2003 | Muthu et al. | |
| 2005/0035939 | A1 * | 2/2005 | Akiyama | 345/102 |
| 2005/0057484 | A1 * | 3/2005 | Diefenbaugh et al. | 345/102 |
| 2005/0058450 | A1 | 3/2005 | Yamamoto et al. | |
| 2005/0116609 | A1 | 6/2005 | Kokubo et al. | |
| 2006/0152468 | A1 | 7/2006 | Ozaki | |
| 2007/0097045 | A1 * | 5/2007 | Lee et al. | 345/82 |
| 2008/0062118 | A1 | 3/2008 | Park | |

FOREIGN PATENT DOCUMENTS

| | | | |
|---|---|---|---|
| CN | 001595254 | A | 3/2005 |
| CN | 001622182 | A | 6/2005 |
| CN | 001662949 | A | 8/2005 |
| CN | 001701350 | A | 11/2005 |

(Continued)

OTHER PUBLICATIONS

European International Search Report for corresponding European Patent Application No. EP 09 01 1693 dated Nov. 29, 2010 (8 pages).

*Primary Examiner* — Shaheda Abdin
(74) *Attorney, Agent, or Firm* — Innovation Counsel LLP

(57) ABSTRACT

A method for driving a light source and maintaining its target white color coordinates despite of varied and decreased light source luminance includes detecting an amount of colored light generated from a plurality of colored light sources, comparing detected colored light to reference data and verifying that colored light source has the correct preset duty cycle. If the colored light source is driven by the preset duty cycle, the method includes modifying the reference data based on the detected light from the colored light source and adjusting the amount of colored light by controlling a driving signal to the colored light sources based on the modified reference data.

23 Claims, 4 Drawing Sheets

(56) References Cited

FOREIGN PATENT DOCUMENTS

| | | | |
|---|---|---|---|
| EP | 1675097 | A2 | 6/2006 |
| KR | 100783500 | B1 | 12/2007 |
| KR | 1020080024323 | A | 3/2008 |
| KR | 1020080034300 | A | 4/2008 |
| WO | 2007100207 | A1 | 9/2007 |

* cited by examiner

METHOD FOR DRIVING A LIGHT SOURCE APPARATUS WITH VARYING LUMINANCE AND A DISPLAY APPARATUS HAVING THE LIGHT SOURCE APPARATUS

PRIORITY STATEMENT

This application claims priority under 35 U.S.C. §119 to Korean Patent Application No. 2008-121123, filed on Dec. 2, 2008 in the Korean Intellectual Property Office (KIPO), the contents of which are herein incorporated by reference in their entirety.

BACKGROUND OF THE INVENTION

1. Field of the Invention

The present invention relates to a light source for a display apparatus and a method for driving the light source.

2. Description of the Related Art

In general, liquid crystal display (LCD) apparatuses are thin, light and have low power consumption, which makes them popular for large television screens, monitors, notebook computers, cellular phones, etc. An LCD apparatus includes an image display panel utilizing the electro-optically controlled light transmittance of liquid crystals and a backlight assembly providing light to the display panel.

The backlight assembly includes a light source generating light to display an image on the display panel. The backlight assembly may apply a cold cathode fluorescent lamp (CCFL) or light-emitting diodes (LED). Nowadays, the backlight assembly mainly employs LEDs instead of CCFL, because LEDs have low power consumption and high color reproducibility.

The display LEDs include a red LED, a green LED and a blue LED. Red, green and blue light generated from the red, green and blue LEDs are mixed into white light. However, the luminance of the LEDs changes according to their usage time, temperature and humidity.

FIG. 1 is a graph illustrating a relationship between the lifetime and luminance of LEDs.

Referring to FIG. 1, LEDs have different luminance characteristics and lifetime depending on LED's color. The lifetime of a red LED is the shortest among the three color LEDs.

The backlight assembly compensates for LED luminance variation to achieve accurate color reproducibility. In a prior art, a backlight assembly detects an amount of light generated by red, green and blue LEDs using color sensors. Then, the backlight assembly adjusts the luminance by comparing the amount of the light detected with the target color coordinates and target luminance, and then optimizing a driving signal to the red, green and blue LEDs.

However, as the usage time of an LED increases, its luminance decreases and the backlight assembly may not be able to match the target white color coordinates and the target luminance.

SUMMARY OF THE INVENTION

According to one aspect of the present invention, a method of driving a light source capable of maintaining target white color coordinates despite of the decreased luminance is provided.

In another aspect, the present invention provides a light source apparatus adequate for applying the method of driving the light source.

Further, the present invention provides a display apparatus having the light source apparatus.

According to another aspect of the present invention, a method for driving a light source includes presetting duty cycles to a plurality of colored light sources, wherein each colored light source has a predetermined reference data of luminance; detecting an amount of colored light generated from a plurality of colored light sources with a plurality of sensors and storing the sensing data; comparing the sensing data with the reference data for a colored light source; modifying the reference data based on the detected colored light from the colored light source, and adjusting the colored light by controlling a driving signal provided to the colored light sources based on the modified reference data.

The method may further include comparing the sensing data with the reference data, and verifying if the colored light source has a preset duty cycle if the sensing data are not equal to the reference data.

Modifying the reference data may include detecting the amount of colored light from the colored light source driven by the preset duty cycle, calculating a ratio between the sensing data and reference data, generating modified data based on the ratio and modifying the reference data based on the modified data.

The preset duty cycle may be the maximum duty cycle.

In an example embodiment, the colored light sources comprises a red light-emitting diode (LED), a green LED and a blue LED.

In The reference data may include a reference amount of red light, a reference amount of green light and a reference amount of blue light forming a target luminance and a target white color coordinates.

The method further may include adjusting the amount of colored light based on the reference data when the colored light source is not driven by a preset duty.

Adjusting the amount of colored light may include converting the amount of colored light into the sensing data of a digital type and controlling the driving signal provided to the colored light sources by comparing the sensing data to the reference data.

According to another aspect of the present invention, a light source apparatus is provided. The light source apparatus includes a light source module having a plurality of colored light sources, a light source driving part driving the colored light sources at a preset duty cycle, a light sensing part detecting an amount of colored light generated by the colored light sources and a light source control part comparing sensing data to reference data, modifying the reference data based on the detected amount of colored light colored light, and adjusting the amount of colored light.

The light source control part may verify if the colored light source is driven by the preset duty cycle when the sensing data are not equal to the reference data.

The colored light sources may include a red LED, a green LED and a blue LED.

The light source apparatus may further include a storage part storing the reference data. The reference data may include a reference amount of red light, a reference amount of green light and a reference amount of blue light forming a target luminance and a target white color coordinates.

In an example embodiment, the light sensing part includes a red light sensor detecting red light generated from the red LED, a green light sensor detecting green light generated from the green LED, a blue light sensor detecting blue light generated from the blue LED, a red light amplifier amplifying the red light output from the red light sensor, a green light amplifier amplifying the green light output from the green light sensor and a blue light amplifier amplifying the blue light output from the blue light sensor.

In an example embodiment, the light source control part includes an analog-to-digital converter (ADC) converting an amount of red light input from the red light amplifier, an amount of green light input from the green light amplifier and an amount of blue light input from the blue light amplifier into sensing data of a digital type, and a control part controlling a driving signal provided to the colored light sources and adjusting the amount of the colored light, by comparing the sensing data and the reference data.

The control part may calculate a ratio between the sensing data of the colored light source and the reference data when the colored light source driven by the preset duty cycle is checked, generates modified data based on the ratio, and modifies the reference data based on the modified data.

According to another aspect of the present invention, a display apparatus is provided. The display apparatus includes a display panel displaying an image, a light source module having a plurality of colored light sources and providing colored light to the display panel, a light source driving part driving the colored light sources at a preset duty cycle, a light sensing part detecting an amount of colored light generated from the colored light sources driven by the light source driving part and a light source control part maintains a colored light source luminance by comparing the sensing data corresponding to the amount of the colored light to the reference data, modifying the reference data based on the amount of colored light driven by the preset duty cycle, and adjusting the amount of colored light.

The display apparatus may further include a user input part receiving information on the target color coordinates and the target luminance from a user. The light source control part may modify the reference data based on the information input from the user input part.

According to the present invention, the target white color coordinates may be maintained even though the luminance of one of the colored light sources varies.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Figure 1:
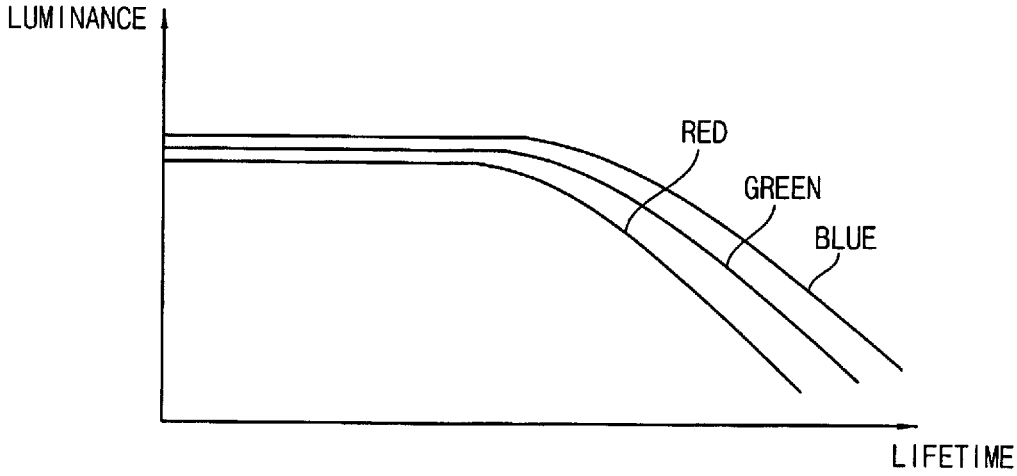
FIG. 1 is a graph illustrating a relationship between the lifetime and luminance of light-emitting diodes (LEDs)

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

Figure 2:
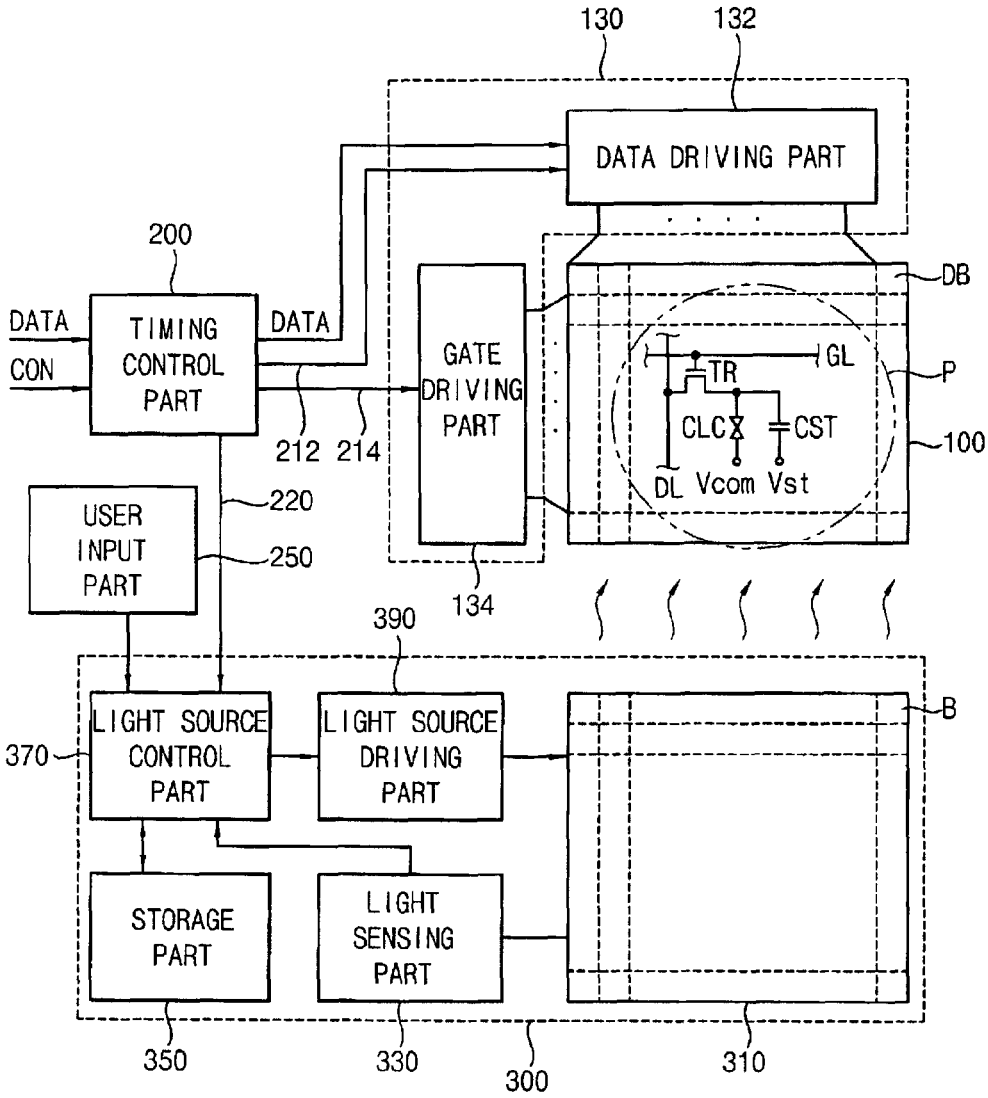
FIG. 2 is a block diagram illustrating a display apparatus according to an example embodiment of the present invention.

FIG. 2 is a block diagram illustrating a display apparatus according to an embodiment of the present invention.

Referring to FIG. 2, the display apparatus according to an embodiment of the present invention includes a display panel 100, a panel driving part 130, a timing control part 200, a user input part 250 and a light source apparatus 300.

The display panel 100 includes a plurality of pixels displaying an image. For example, the number of pixels may be M×N (M and N are natural numbers). Each pixel P includes a switching element TR connected to a gate line GL and a data line DL, a liquid crystal capacitor CLC connected to the switching element TR and a storage capacitor CST.

The timing control part 200 receives a control signal CON and an image signal DATA. The control signal CON may include a vertical synchronizing signal, a horizontal synchronizing signal and a clock signal. The timing control part 200 generates a panel control signal 212 using the control signal CON in order to control the panel driving part 130. The timing control part 200 generates a light source control signal 214 using the control signal CON in order to control the light source apparatus 300.

The panel driving part 130 drives the display panel 100 using the panel control signal 212 from the timing control part 200.

The panel driving part 130 may include a data driving part 132 and a gate driving part 134. The panel control signal 212 includes a first control signal 212*a* controlling a driving timing of the data driving part 132 and a second control signal 212*b* controlling a driving timing of the gate driving part 134. The first control signal 212*a* may include a clock signal and a horizontal starting signal. The second control signal 212*b* may include a vertical starting signal.

The data driving part 132 generates a data signal using the first control signal 212*a* and the image signal DATA. The data driving part 132 provides the data signal to the data line DL.

The gate driving part 134 generates a gate signal using the second signal 212*b*. The gate signal turns on the gate line GL. The gate driving part 134 provides the gate signal to the gate line GL.

The user input part 250 includes a user interface inputting a user input signal. From a user, the user input part 250 receives color characteristic information of light in order to adjust color and luminance characteristics of the light output from the light source apparatus 300. The user input part 250 provides the color characteristic information of the light to the light source apparatus 300. For example, the user input part 250 may be disposed outside of a case of the display panel 100.

The light source apparatus 300 provides the light to the display panel 100 in response to the light source control signal 214 received from the timing control part 200.

The light source apparatus 300 includes a light source module 310, a light sensing part 330, a storage part 350, a light source control part 370 and a light source driving part 390.

The light source module 310 includes a plurality of colored light sources and a driving substrate on which the colored light sources are disposed. The colored light sources includes a red light-emitting diode (LED) generating red light, a green LED generating green light and a blue LED generating blue light. The light source module 310 includes M×N (M and N are natural numbers) light-emitting blocks B. Each light-emitting block B may include a plurality of LEDs.

The light sensing part 330 detects an amount of red light, an amount of green light and an amount of blue light generated from the red, green and blue LEDs. The light sensing part 330 provides the detected amounts of the red light, the green light and the blue light to the light source control part 370.

The storage part 350 stores a plurality of reference data required to adjust the amount of the red light, the amount of the green light and the amount of the blue light of the red, green and blue LEDs. The reference data may include the amount of the red light, the amount of the green light and the amount of the blue light corresponding to target luminance and target white color coordinates. The reference data may be obtained by a test in a production process. The reference data may be modified corresponding to the color characteristic information input from the user input part 250. When an amount of colored light is small among the colored light sources, the reference data may be modified based on the amount of colored lights.

Although not shown in figures, the storage part 350 may be disposed in the light source control part 370.

The light source control part 370 analyzes an image signal DATA input from outside of the display apparatus. The light source control part 370 outputs a dimming signal in order to control the light-emitting blocks B. The light source control part 370 adjusts the amount of the colored light by comparing colored light intensity data detected by the light sensing part 330 and the reference data stored in the storage part 350. The light source control part 370 may adjust the amount of the colored light by controlling a driving signal received from the colored light sources. For example, the light source control part 370 may adjust the amount of the colored light by modulating a pulse width of a current signal received from colored light sources such that the target white coordinates and the target luminance are maintained. The light source control part 370 may adjust the amount of the colored light by modulating a current signal level received from the colored light sources.

The light source control part 370 checks whether a colored light source is driven by a preset duty cycle when the sensing data are not equal to the reference data. The preset duty cycle may be the maximum duty cycle (100%). The light source control part 370 modifies the reference data based on the amount of colored light from the colored light source driven by the preset duty cycle, if the colored light source driven by the preset duty cycle exists. The light source control part 370 controls the light sensing part 330 to detect the amount of colored light from the colored light source driven by the preset duty cycle. The light source control part 370 calculates a ratio between the detected light data from the colored light source driven by the preset duty cycle and reference data. Based on the ratio, the light source control part 370 generates modified data in order to modify the reference data. For example, the light source control part 370 may generate the modified data by multiplying the reference data and the ratio. The light source control part 370 provides the modified data to the storage part 350 in order to modify the reference data of the storage part 350. The light source control part 370 adjusts the amount of colored light of the colored light sources based on the modified reference data.

The light source control part 370 may modify the reference data based on the color characteristic information input from the user input part 250 when the color characteristic information is input from the user input part 250 by a user.

The light source driving part 390 drives the light-emitting blocks based on the red, green and blue driving signals received by the light source control part 370.

Figure 3:
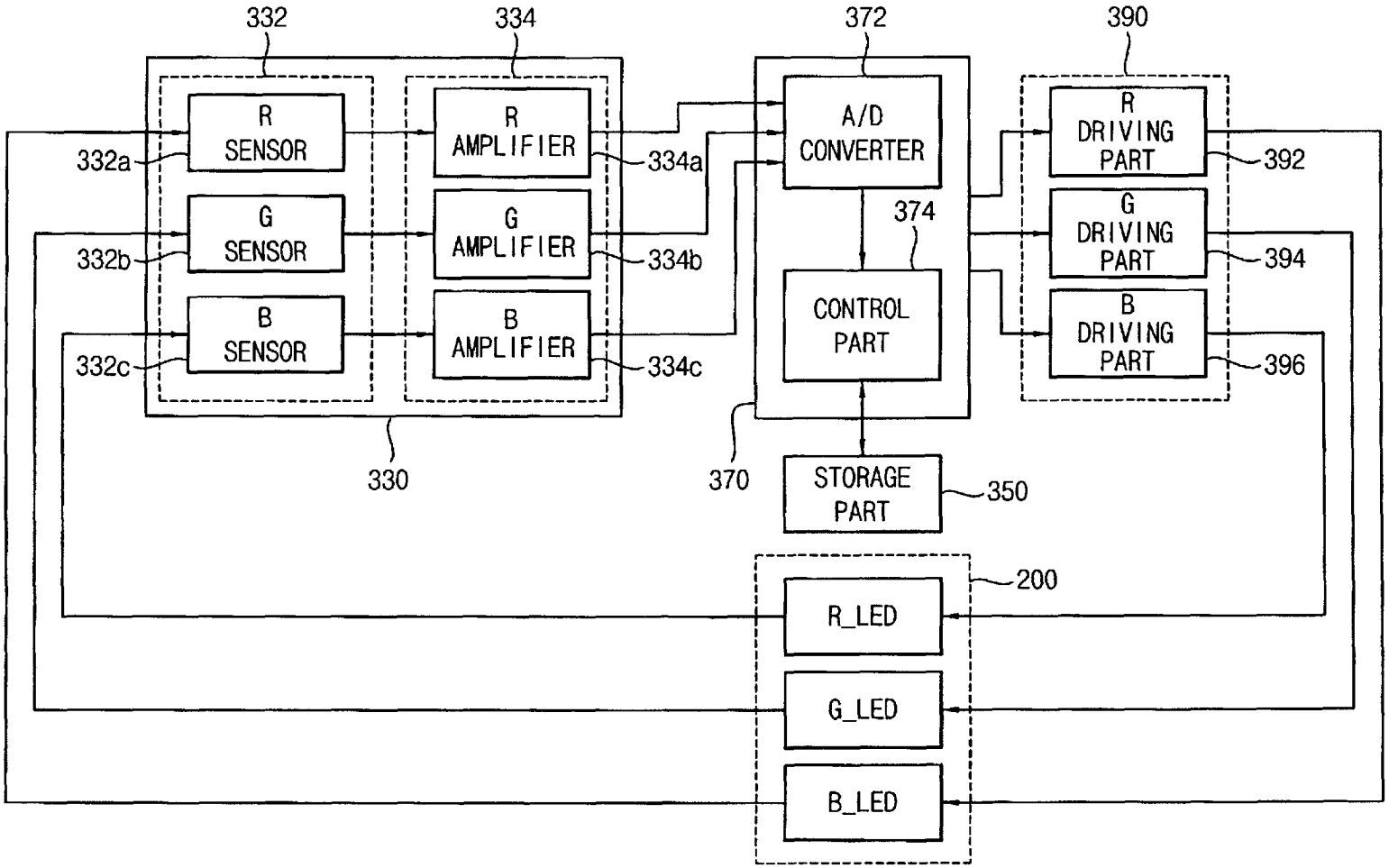
FIG. 3 is a detailed block diagram illustrating the light source apparatus of FIG. 2.

FIG. 3 is a detailed block diagram illustrating the light source apparatus of FIG. 2.

Referring to FIGS. 2 and 3, the light source apparatus 300 includes a light source module 310, a light sensing part 330, a storage part 350, a light source control part 370 and a light source driving part 390.

The light source module 310 includes a red LED (R_LED), a green LED (G_LED) and a blue LED (B_LED).

The light sensing part 330 includes a light sensor 332 and an amplifier 334.

The light sensor 332 includes a red light sensor 332*a* detecting an amount of red light generated by the red LED R_LED, a green light sensor 332*b* detecting an amount of the green light generated by the green LED G_LED and a blue light sensor 332*c* detecting an amount of the blue light generated by the blue LED B_LED. The light sensor 332 may be disposed on the center of the light source module 310. The light sensor 332 may be disposed on the side of the light source module 310.

The amplifier 334 includes a red light amplifier 334*a* amplifying the red light output from the red light sensor 332*a*, a green light amplifier 334*b* amplifying the green light output from the green light sensor 332*b* and a blue light amplifier 334*c* amplifying the blue light output from the blue light sensor 332*c*. Each of the red, green and blue light amplifiers 334*a*, 334*b* and 334*c* may include an operational amplifier (op-amp) as a low-pass filter (LPF).

The light source control part 370 includes an analog-to-digital converter (ADC) 372 and a control part 374.

The ADC 372 converts the red, green and blue sensing signals into red, green and blue sensing data of a digital type.

The control part 374 compares the sensing data to reference data stored by the storage part 350. The control part 374 checks if a colored light source is driven by a preset duty cycle when the sensing data are not equal to the reference data. The light source control part 370 modifies the reference data based on the amount of the colored light of the colored light source driven by the preset duty cycle when the colored light source is driven by the preset duty cycle. The control part 374 controls the light sensing part 330 to detect the amount of colored light from the colored light source driven by the preset duty cycle. The control part 374 calculates a ratio between the sensing data of the colored light source driven by the preset duty cycle and the reference data. The control part 374 generates modified reference data by multiplying the reference data and the ratio. The light source control part 370 provides the modified data to the storage part 350 in order to modify the reference data of the storage part 350. The light source control part 370 adjusts the amount of colored light from the colored light sources based on the modified reference data.

The light source driving part 390 includes a red driving part 392 providing a red driving signal to the red LED R_LED, a green driving part 394 providing a green driving signal to the green LED G_LED and a blue driving part 396 providing a blue signal to the blue LED B_LED.

Figure 4:
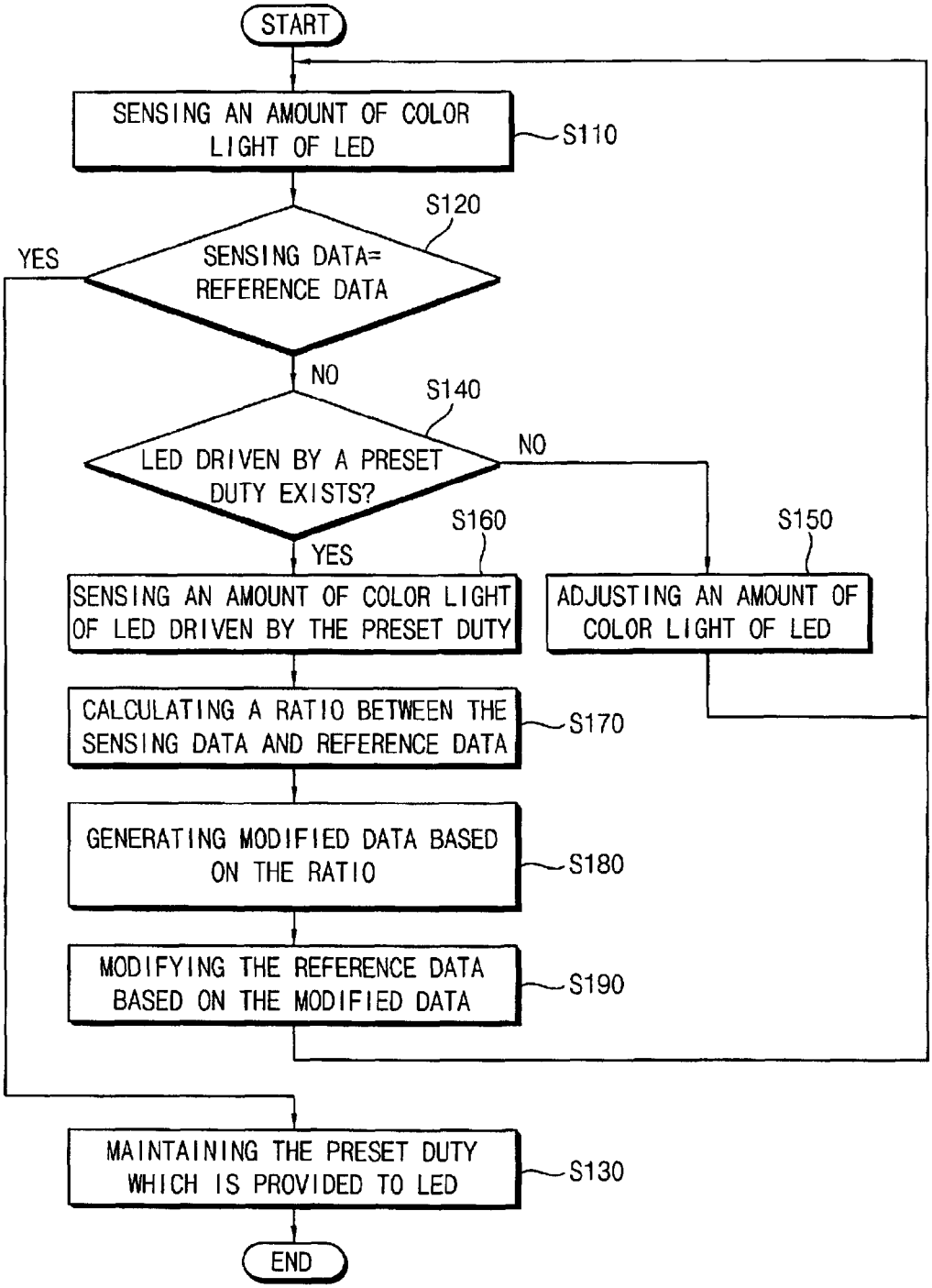
FIG. 4 is a flowchart showing a method for driving the light source apparatus in FIG. 3.

FIG. 4 is a timing diagram illustrating a method for driving a light source apparatus.

Referring to FIGS. 3 and 4, the light sensing part 330 detects an amount of red light, an amount of green light and an amount of the blue light generated from the red, green and blue LEDs R_LED, G_LED and B_LED (step S110). The light sensing part 330 amplifies the red, green and blue sensing signals. The light sensing part 330 outputs the amplified red, green and blue sensing signals to the ADC 372. The ADC 372 converts the red, green and blue sensing signals into digital data. The ADC 372 outputs the digital data.

The control part 374 checks whether the red, green and blue sensing data equal to the reference data stored by the storage part 350 (step S120).

When the red, green and blue sensing data equal to the reference data in step S120, the control part 374 maintains a preset duty cycle of a driving signal provided to the red, green and blue LEDs R_LED, G_LED and B_LED (step S130).

When the red, green and blue sensing data are not equal to the reference data in step S120, the control part 374 checks whether there exists a LED driven by the preset duty cycle among the red, green and blue LEDs R_LED, G_LED and BLED (step S140).

If the LED driven by the preset duty cycle does not exist in step S140, the control part 374 adjusts the amounts of the red light, green light and blue light by resetting the driving signal duty cycle of the red, green and blue diodes R_LED, G_LED and B_LED so that the red, green and blue sensing data are equal to the reference data (step S150). The process is fed back to step S110. Steps S110 to S140 are repetitively performed.

If the LED driven by the preset duty cycle exists in step S140, the control part 374 controls the light sensing part 330 to detect the amount of colored light from the LED driven by the preset duty cycle. The light sensing part 330 detects the amount of colored light from the LED driven by the preset duty cycle according to a control of the control part 374 (step S160).

The control part 374 calculates a ratio between the sensing data of the LED driven by the preset duty cycle and the reference data of the LED driven by the preset duty cycle (step S170).

Based on the ratio, the control part 374 generates modified data in order to modify the reference data (step S180). For example, the control part 374 may generate the modified data by multiplying the reference data and the ratio.

The control part 374 changes the reference data to the modified data (step S190). The process is fed back to step S120. Step S120 is performed again.

According to the present invention, when one of the red, green and blue LEDs R_LED, G_LED and B_LED has decreased luminance, the reference data is modified based on the amount of the detected colored light from the LED having decreased luminance. By adjusting an amount of red light, an amount of green light and an amount of blue light with respect to the modified reference data, the target white color coordinates may always be maintained. Therefore, the images quality of a display apparatus may be improved. Although the exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A method for driving a light source, the method comprising:

presetting duty cycles to a plurality of colored light sources, wherein each colored light source has a predetermined reference data of luminance;

detecting an amount of luminance of colored light generated from a plurality of colored light sources with a plurality of sensors and storing a sensing data based on the amount of luminance of colored light detected;

comparing the sensing data with the predetermined reference data for a colored light source;

modifying the predetermined reference data based on the detected amount of luminance of colored light from the colored light source using a ratio between the sensing data and the reference data to determine a modified reference data; and adjusting the amount of luminance of colored light from the colored light sources by controlling a driving signal provided to the colored light sources based on the modified reference data.

2. The method of claim 1, further comprising verifying if the colored light source has a preset duty cycle if the sensing data are not equal to the reference data.

3. The method of claim 2, wherein modifying the reference data comprises:

detecting the amount of luminance of colored light from the colored light source driven by the preset duty cycle;

calculating the ratio between the sensing data and the reference data;

generating modified data based on the ratio; and modifying the reference data based on the modified data.

4. The method of claim 3, wherein the colored light sources comprises a red light-emitting diode (LED), a green LED and a blue LED.

5. The method of claim 4, wherein the reference data comprises a reference amount of luminance of red light, a reference amount of luminance of green light and a reference amount of luminance of blue light corresponding to a target luminance and a target white color coordinates.

6. The method of claim 1, wherein the preset duty cycle is the maximum duty cycle.

7. The method of claim 1, further comprising adjusting the amount of luminance of the colored light based on the reference data when the colored light source is not driven by the preset duty cycle.

8. The method of claim 7, wherein adjusting the amount of luminance of the colored light comprising:

converting the amount of luminance of the colored light into the sensing data of a digital type; and controlling the driving signal provided to the colored light sources by comparing the sensing data to the reference data.

9. A light source apparatus comprising:

a light source module having a plurality of colored light sources wherein each colored light source has a predetermined reference data of luminance;

a light source driving part configured to drive the colored light sources at a preset duty cycle;

a light sensing part configured to detect an amount of luminance of colored light generated by the colored light sources and to store a sensing data based on the amount of luminance of colored light detected; and a light source control part configured to compare the sensing data with the predetermined reference data, to modify the predetermined reference data based on the detected amount of luminance of colored light using a ratio between the sensing data and the reference data to determine a modified reference data and to adjust the amount of luminance of colored light based on the modified reference data.

10. The light source apparatus of claim 9, wherein the light source control part is configured to verify if the colored light source is driven by the preset duty cycle when the sensing data are not equal to the reference data.

11. The light source apparatus of claim 10, wherein the preset duty cycle is the maximum duty cycle.

12. The light source apparatus of claim 10, wherein the colored light sources comprise a red LED, a green LED and a blue LED.

13. The light source apparatus of claim 12, further comprising a storage part configured to store the reference data, wherein the reference data comprises a reference amount of luminance of red light, a reference amount of luminance of green light and a reference amount of luminance of blue light forming a target white light luminance and a target white color coordinates.

14. The light source apparatus of claim 12, wherein the light sensing part comprises:

a red light sensor configured to detect red light generated from the red LED, a green light sensor configured to detect green light generated from the green LED and a blue light sensor configured to detect blue light generated from the blue LED; and a red light amplifier configured to amplify the red light output from the red light sensor, a green light amplifier configured to amplify the green light output from the green light sensor and a blue light amplifier configured to amplify the blue light output from the blue light sensor.

15. The light source apparatus of claim 14, wherein the light source control part comprises:

an analog-to-digital converter (ADC) configured to convert an amount of luminance of the red light input from the red light amplifier, an amount of luminance of the green light input from the green light amplifier and an amount of luminance of the blue light input from the blue light amplifier into sensing data of a digital type; and a control part configured to control a driving signal provided to the colored light sources and adjusting the amount of luminance of the colored light, by comparing the sensing data and the reference data.

16. The light source apparatus of claim 14, wherein the control part configured to calculate the ratio between the sensing data of the colored light source and the reference data when the colored light source driven by the preset duty cycle is checked, to generate modified data based on the ratio, and to modify the reference data based on the modified data.

17. A display apparatus comprising:

a display panel configured to display an image;

a light source module having a plurality of colored light sources and configured to provide colored light to the display panel;

a light source driving part configured to drive the colored light sources at a preset duty cycle;

a light sensing part configured to detect an amount of luminance of colored light generated from the colored light sources driven by the light source driving part; and a light source control part of luminance maintains a colored light source luminance by comparing a a sensing data corresponding to the amount of luminance of colored light to a predetermined reference data, to modify the predetermined reference data based on the amount of luminance of colored light driven by the preset duty cycle using a ratio between the sensing data and the reference data to determine a modified reference data, and to adjust the amount of luminance of colored light based on the modified reference data.

18. The display apparatus of claim 17, wherein the light source control part is configured to verify if the colored light source is driven by the preset duty cycle when the sensing data are not equal to the reference data.

19. The display apparatus of claim 17, wherein the colored light sources comprises a red LED, a green LED and a blue LED, and wherein the reference data comprise a reference amount of luminance of red light, a reference amount of luminance of green light and a reference amount of luminance of blue light forming a target luminance and target white color coordinates.

20. The display apparatus of claim 19, further comprising a user input part configured to receive information on the target color coordinates and the target luminance from a user, and wherein the light source control part is configured to modify the reference data based on the information input from the user input part.

21. The display apparatus of claim 18, wherein the light source control part comprises:

an ADC configured to convert the amount of luminance of the colored light detected by the light sensing part into the sensing data of a digital type; and a control part configured to control a driving signal provided to the colored light sources and to adjust the amount of luminance of the colored light, by comparing the sensing data and the reference data.

22. The display apparatus of claim 21, wherein the control part is configured to calculate the ratio between the sensing data and the reference data, to generate modified data based on the ratio, and to modify the reference data based on the modified data.

23. The light source apparatus of claim 22, wherein the preset duty cycle is the maximum duty cycle.

* * * * *